US008540869B2

(12) United States Patent
Zakarian et al.

(10) Patent No.: US 8,540,869 B2
(45) Date of Patent: Sep. 24, 2013

(54) METHOD FOR FORMING FINISHED LUBRICANTS

(75) Inventors: John A. Zakarian, Hercules, CA (US); Angelito T. Tirona, Daly City, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1041 days.

(21) Appl. No.: 12/000,184

(22) Filed: Dec. 10, 2007

(65) Prior Publication Data

US 2009/0149360 A1 Jun. 11, 2009

(51) Int. Cl.
*C10M 173/00* (2006.01)
*C10M 111/00* (2006.01)
*C10M 145/14* (2006.01)

(52) U.S. Cl.
USPC ..... 208/19; 208/18; 508/469; 73/53.05; 73/54.02; 73/114.56

(58) Field of Classification Search
USPC ..... 208/18, 19; 508/469; 73/53.05, 73/53.06, 54.01, 54.02, 114.56
See application file for complete search history.

(56) References Cited

U.S. PATENT DOCUMENTS

| | | | | |
|---|---|---|---|---|
| 3,852,207 | A | 12/1974 | Stangeland et al. | |
| 4,673,487 | A | 6/1987 | Miller | |
| 5,641,732 | A | 6/1997 | Bloch et al. | |
| 6,080,301 | A * | 6/2000 | Berlowitz et al. | 208/18 |
| 6,255,546 | B1 * | 7/2001 | Alexander | 585/1 |
| 2005/0043192 | A1 * | 2/2005 | Alexander | 508/469 |
| 2006/0201852 | A1 * | 9/2006 | Rosenbaum et al. | 208/19 |

FOREIGN PATENT DOCUMENTS

| | | |
|---|---|---|
| EP | 0 418 610 | 3/1991 |
| EP | 1 808 476 | 7/2007 |
| EP | 1 887 075 | 2/2008 |
| WO | WO 90/09362 | 8/1990 |
| WO | WO 2005/066314 A1 | 7/2005 |
| WO | WO 2006/101206 | 9/2006 |
| WO | WO 2009/042396 | 4/2009 |

OTHER PUBLICATIONS

Viscoplex ® 0-050 http://web.archive.org/web/20070302131024/www.rohmax.com/rohmax/en/customerservices/calculationtools/blendingefficiency/1/2007.*

Dornte, R.W., "Oxidation of White Oils", *Industrial and Engineering Chemistry* vol. 28, p. 26 1936.

Doddrell, D.T., et al., "Distortionless Enhancement of NMR Signals by Polarization Transfer", *Journal of Magnetic Resonance* 48:323-327 (1982).

Patt, S.L. and Shoolery, J.N., :Attached Proton Test for Carbon-13 NMR, *Journal of Magnetic Resonance* 46:535-530 (1982).

Lindeman, L.P., "Carbon-13 Nuclear Magnetic Resonance Spectrometry", *Analytical Chemistry* 43:1245-1252 (1971).

Netzel, D.A., et al., "1H- and 13C-m.n. r. studies on naphtha and light distillate saturate hydrocarbon fractions obtained from in-situ shale oil", *Fuel*, 60:307-320 (1981).

Kwon, Wan-Seop, et al., "Effects of Dumbbell Blending of Light and Heavy Hydrocracked Base Oils on the Performance of Automatic Transmission Fluids", *STLE Tribology Transactions* vol. 49, No. 4, pp. 41-52 (2005).

International Preliminary Report from PCT/US2008/083889, mailed Jun. 24, 2010, 6 pages.

Extended European Search Report dated Sep. 27, 2012, issued in the corresponding European Application No. 08859628, 11 pages.

* cited by examiner

*Primary Examiner* — Pamela H Weiss
(74) *Attorney, Agent, or Firm* — Merchant & Gould

(57) ABSTRACT

A method for forming a finished lubricant comprises selecting a target high temperature viscosity for the finished lubricant. A target high temperature viscosity for a base oil blend is selected. The target high temperature viscosity for the base oil blend is less than the target high temperature viscosity for the finished lubricant. At least two base oils from at least three viscosity grades of base oils are selected and mixed to form a base oil blend that meets the target high temperature viscosity for the base oil blend. The base oil blend is mixed with performance additive package and viscosity modifier to provide a finished lubricant that meets the target high temperature viscosity for the finished lubricant. The at least two base oils for the base oil blend having the target high temperature viscosity are selected such that less viscosity modifier is needed to meet the target high temperature viscosity of the finished lubricant.

15 Claims, No Drawings

METHOD FOR FORMING FINISHED LUBRICANTS

FIELD OF ART

The present disclosure relates to methods for forming finished lubricants, in particular, automatic transmission fluids. More specifically, the present disclosure relates to methods for forming finished lubricants requiring less viscosity modifier to meet the target high temperature viscosity of the finished lubricant.

BACKGROUND

Finished lubricants, such as, for example, automatic transmission fluids (ATFs), can be manufactured by blending low viscosity base oils with very-high-molecular-weight polymers. The polymers are used to provide a higher viscosity at high operating temperatures, compared to the viscosity of the base fluid and additives alone. This increase in high-temperature viscosity must be obtained without comprising the viscosity at lower temperatures. That is, the finished lubricant must have excellent low temperature pumpability. Pumpability requirements limit the selection of polymers to those which have desired solubility characteristics over a wide temperature range. Polymethacrylate polymers are particularly preferred in ATF applications.

SUMMARY

In an embodiment, a method for forming a finished lubricant comprises selecting a target high temperature viscosity for the finished lubricant. A target high temperature viscosity for a base oil blend is selected. The target high temperature viscosity for the base oil blend is less than the target high temperature viscosity for the finished lubricant. At least two base oils from at least three viscosity grades of base oils are selected and mixed to form a base oil blend that meets the target high temperature viscosity for the base oil blend. The base oil blend is mixed with performance additive package and viscosity modifier to provide a finished lubricant that meets the target high temperature viscosity for the finished lubricant. The at least two base oils for the base oil blend having the target high temperature viscosity are selected such that less viscosity modifier is needed to meet the target high temperature viscosity of the finished lubricant.

In an embodiment, a method for making a base blend with improved polymer thickening efficiency comprises (a) selecting two or more viscosity grades of base oil made from a waxy feed; (b) blending the two or more viscosity grades of base oil to a target viscosity; (c) blending the two or more viscosity grades of base oil with a fixed amount of performance additive package to form a base blend; (d) blending the base blend with a fixed amount of viscosity modifier to form a finished lubricant; (e) measuring the viscosity of the finished lubricant; (f) calculating a difference between the viscosity of the finished lubricant and the viscosity of the base oil blend; (g) repeating steps (a) through (f) at least once with different selections of the two or more viscosity grades of base oil made from a waxy feed; and (h) comparing differences between the viscosity of the finished lubricant and the viscosity of the base oil blend to determine which selection of the two or more viscosity grades of base oil provides the greatest difference.

In an embodiment, a method for forming an automatic transmission fluid comprises selecting a target high temperature viscosity for the automatic transmission fluid. A target high temperature viscosity for a base oil blend is selected. An extra-light base oil fraction, a light base oil fraction, a medium-light base oil fraction, and a medium base oil fraction are provided. The medium base oil fraction and light base oil fraction are mixed to form a base oil blend that meets the target high temperature viscosity of the base oil blend. The base oil blend is mixed with performance additive package and viscosity modifier to form an automatic transmission fluid that meets the target high temperature viscosity of the automatic transmission fluid. The medium base oil fraction and light base oil fraction for the base oil blend having the target high temperature viscosity are selected such that the amount of viscosity modifier needed to meet the target high temperature viscosity of the automatic transmission fluid is minimized.

DETAILED DESCRIPTION

It has been surprisingly discovered that some unexpected interactions exist in the blending of polymers with base oils made by the Gas-to-Liquids (GTL) process. A base fluid for an ATF was made by blending two different GTL base oils in order to obtain a specified base fluid viscosity. It was surprisingly found that the thickening efficiency of polymethacrylate polymer (PMA) (which is the increase in viscosity provided by the PMA above that of the base fluid) is different depending on the selection of GTL base oils in the base fluid mix. Normally, it would be expected that PMA added to a base fluid of specified viscosity would give the same viscosity increase, irrespective of how the base fluid was prepared. The thickening efficiency is dependent on the solubility properties of the PMA in the solvent (i.e., the base fluid). All of the GTL base oils have very similar chemical properties, such as a high degree of paraffinicity and an extremely low level of aromatics. Thus, the solvent properties should be very similar, irrespective of which GTL base oils are blended together. Thus, it has been surprisingly discovered, that the amount of PMA needed in order to make lubricants such as an ATF can be optimized. By a judicious choice of base oils, less PMA can be used while still obtaining the maximum amount of viscosity increase.

Accordingly, an ATF base fluid comprising a careful choice of base oils may be used to form an ATF meeting a target high temperature viscosity. The ATF base fluid comprising the careful choice of base oils requires less viscosity modifier to meet the target high temperature viscosity in comparison to an ATF base fluid comprising a different choice of base oils. Less viscosity modifier is a decrease of at least 0.02 weight % viscosity modifier that is needed to meet a high temperature viscosity target compared to the amount of viscosity modifier needed to meet a high temperature viscosity target in a comparable base oil or base oil blend of approximately the same kinematic viscosity. Approximately the same kinematic viscosity is a kinematic viscosity at 100° C. within 0.20 $mm^2/s$. In particular, without wishing to be bound by any theory, it is believed that the base oils that provide the greatest thickening efficiency of PMA in a mixture of base oils are those which are most similar in composition and boiling range. Compositional properties that interact to improve thickening efficiency are amounts of alkyl branches per 100 carbons and weight % of different carbon types. Polymeric viscosity modifiers are customarily used in ATF formulations to increase the viscosity at high temperature (e.g., 100° C.), while maintaining reasonable fluidity at low temperature (e.g., −40° C.).

DEFINITIONS AND TERMS

The following terms will be used throughout the specification and will have the following meanings unless otherwise indicated.

In the context of this disclosure, the phrase "extra-light base oil" or "XLBO" refers to a base oil having a kinematic viscosity at 100° C. between about 2.0 and about 3.8 $mm^2/s$, the phrase "light base oil" or "LBO" refers to a base oil having a kinematic viscosity at 100° C. between about 3.8 and about 5.0 $mm^2/s$, the phrase "medium-light base oil" or "MLBO" refers to a base oil having a kinematic viscosity at 100° C. between about 5.0 and about 6.8 $mm^2/s$, and the phrase "medium base oil" or "MBO" refers to a base oil having a kinematic viscosity at 100° C. between about 6.8 and about 10.0. Kinematic viscosity is measured according to ASTM D445-06, and reported in $mm^2/s$.

The phrase "high temperature" refers to the upper range of operating temperatures for an ATF, for example, between about 70 and about 170° C., and in particular, about 100° C. The phrase "low temperature" refers to the lower range of operating temperatures for an ATF, for example, between about 0 and about −55° C., and in particular, about −40° C.

The phrase "high temperature viscosity" refers to the kinematic viscosity of an ATF in the high temperature upper range of operating temperatures for the ATF, while the phrase "low temperature viscosity" refers to the Brookfield viscosity of the ATF in the low temperature lower range of operating temperatures for the ATF. On a related note, the phrase "target high temperature viscosity" refers to a desired high temperature viscosity for an ATF in formulating an ATF, while the phrase "target low temperature viscosity" refers to a desired low temperature viscosity for an ATF in formulating an ATF. Brookfield viscosity is measured by ASTM D 2983-04a, and the results are reported in mPa·s at the test temperature.

The phrase "target flash point" refers to a desired flash point for an ATF base fluid to be used in formulating an ATF. As described below, flash point of the ATF base fluid is among a number of targets in mixing base oils to form an ATF base fluid, and ultimately, an ATF.

The phrase "target oxidation stability" refers to a desired oxidation stability for an ATF base fluid to be used in formulating an ATF. As described below, oxidation stability of the ATF base fluid is among a number of targets in mixing base oils to form an ATF base fluid, and ultimately, an ATF. In particular, oxidation stability may be measured according to Oxidator BN values. In one embodiment, the Oxidator BN will be between 25 and 70 hours.

The phrase "target Noack volatility" refers to a desired low volatility of the base oil. "Noack volatility" is defined as the mass of oil, expressed in weight %, which is lost when the oil is heated at 250° C. with a constant flow of air drawn through it for 60 minutes, measured according to ASTM D5800-05, Procedure B. Noack volatility is not related to Oxidation Stability. It is an additional desired property—giving lower flammability and lower volatile emissions.

Oxidator BN is a convenient way to measure the oxidation stability of base oils. The Oxidator BN test is described by Stangeland et al. in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of $O_2$ by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3,565 ppm. The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application. High values, or long times to absorb one liter of oxygen, indicate good oxidation stability. OLOA is an acronym for Oronite Lubricating Oil Additive®, which is a registered trademark of Chevron Oronite.

In an embodiment, provided is a method for forming a finished lubricant. The method comprises selecting a target high temperature viscosity for the finished lubricant. A target high temperature viscosity for a base oil blend is selected. The target high temperature viscosity for the base oil blend is less than the target high temperature viscosity for the finished lubricant. At least two base oils from at least three viscosity grades of base oils are selected and mixed to form a base oil blend that meets the target high temperature viscosity for the base oil blend. Base oil viscosity grades are base oils with kinematic viscosities that differ from each other, such as by more than 0.5 $mm^2/s$ or by more than 1.0 $mm^2/s$ at 100° C. The base oil blend is mixed with a performance additive package and a viscosity modifier to provide a finished lubricant that meets the target high temperature viscosity for the finished lubricant. The at least two base oils for the base oil blend having the target high temperature viscosity are selected such that less viscosity modifier is needed to meet the target high temperature viscosity of the finished lubricant.

The at least two base oils can be different viscosity grades made from a waxy feed. Specifically, two base oils can be blended to form the base oil blend. The base oils can be Fischer-Tropsch derived. The viscosity modifier can be a high molecular weight polymer, for example, polymethacrylate.

In one embodiment, the at least two base oils have excellent viscometric properties under low temperature and high shear, making them very useful in transmission fluids. The cold-cranking simulator apparent viscosity (CCS VIS) is a test used to measure the viscometric properties of lubricating base oils under low temperature and high shear. The test method to determine CCS VIS is ASTM D 5293-04. Results are reported in mPa·s. The CCS VIS measured at −35° C. of the at least two base oils are low, for example less than an amount calculated by the equation:

$$\text{CCS VIS}(-35^\circ\text{ C.}),\text{mPa·s}=38\times(\text{Kinematic Viscosity at }100^\circ\text{ C.})^3,$$

or less than an amount calculated by the equation:

$$\text{CCS VIS}(-35^\circ\text{ C.}),\text{mPa·s}=38\times(\text{Kinematic Viscosity at }100^\circ\text{ C.})^{2.8}.$$

In one embodiment, the at least two base oils have low Noack volatilities, for example, a Noack volatility less than an amount calculated by the following equation:

$$1000\times(\text{Kinematic Viscosity at }100^\circ\text{ C.})^{-2.7}.$$

In another embodiment, the at least two or more base oils have Noack volatilities less than an amount calculated by the following equation:

$$900\times(\text{Kinematic Viscosity at }100^\circ\text{ C.})^{-2.8}.$$

In one embodiment, at least one of the at least two or more base oils has a kinematic viscosity at 100° C. between 1.5 and 4.0 $mm^2/s$, and a weight % Noack volatility between 0 and 100; wherein the Noack volatility is less than the amount calculated by the following equation:

$$160-40(\text{Kinematic Viscosity at } 100^\circ \text{ C.}).$$

In one embodiment, at least one of the at least two or more base oils has a kinematic viscosity at 100° C. in the range of 2.4 and 3.8 $mm^2/s$ and a Noack volatility less than an amount defined by the equation:

$$900\times(\text{Kinematic Viscosity at } 100^\circ \text{ C.})^{-2.8}-15.$$

For kinematic viscosities in the range of 2.4 and 3.8 $mm^2/s$, the equation:

$$900\times(\text{Kinematic Viscosity at } 100^\circ \text{ C.})^{-2.8}-15$$

provides a lower Noack volatility than the equation:

$$160-40(\text{Kinematic Viscosity at } 100^\circ \text{ C.}).$$

In one embodiment, at least one of the at least two or more base oils is made from a process in which a highly paraffinic wax is hydroisomerized under conditions for the base oil to have a kinematic viscosity at 100° C. of 3.6 to 4.2 $mm^2/s$, a viscosity index of greater than 130, a weight % Noack volatility less than 12, and a pour point of less than −9° C. Viscosity Index is measured by ASTM D2270-04.

In one embodiment, at least one of the at least two or more base oils has a high viscosity index, such that the value of y in the equation:

$$VI=28\times\text{Ln}(\text{Kinematic Viscosity at } 100^\circ \text{ C.})+y,$$

is greater than 95. Other values of y can be greater than 100 or 105. In another embodiment, the at least two or more base oils all have a high viscosity index, such that the value of y in the equation given above for all of the at least two or base oils is greater than 95.

In order to make a commercially viable ATF, a low temperature viscosity specification (e.g., a Brookfield viscosity specification at a temperature of −40° C.) must also be met. For example, for DEXRON®-VI ATF, the maximum allowable Brookfield viscosity is 15,000 mPa·s at −40° C. The choice of base fluid can have a significant effect on the Brookfield behavior.

Thus, the method can further comprise selecting a target low temperature viscosity for the finished lubricant, and the at least two base oils can be selected and mixed to meet the target high temperature viscosity and the target low temperature viscosity. The target low temperature viscosity can be a Brookfield viscosity at −40° C. and the target high temperature viscosity can be a kinematic viscosity at 100° C. In particular, the target low temperature viscosity of the finished lubricant can be between about 2,000 and about 20,000 mPa·s, the target high temperature viscosity of the finished lubricant can be a viscosity at 100° C. of between about 4 and about 10 $mm^2/s$, and/or the target high temperature viscosity of the base oil blend can be between about 3 and about 7.5 $mm^2/s$.

The base oil blend can have a target flash point of not lower than 170° C. The base oil blend can have a target oxidation stability defined by an Oxidator BN value greater than about 25 and less than about 70. The base oil blend can have a Viscosity Index between about 130 and about 170. The finished lubricant can be an automatic transmission fluid. The automatic transmission fluid can meet the specifications for DEXRON-VI.

In an embodiment, provided is a method for making a base blend with improved polymer thickening efficiency. The method comprises (a) selecting two or more viscosity grades of base oil made from a waxy feed; (b) blending the two or more viscosity grades of base oil in order to meet a target high temperature viscosity for the base oil blend; (c) blending the two or more viscosity grades of base oil with a performance additive package to form a base blend; (d) blending the base blend with a viscosity modifier to form a finished lubricant; (e) measuring the viscosity of the finished lubricant; (f) calculating a difference between the viscosity of the finished lubricant and the viscosity of the base blend; (g) repeating steps (a) through (f) at least once with different selections of the two or more viscosity grades of base oil made from a waxy feed; and (h) comparing differences between the viscosity of the finished lubricant and the viscosity of the base blend to determine which selection of the two or more viscosity grades of base oil provides the greatest difference.

The following illustrative example is intended to be non-limiting.

EXAMPLE

Four different GTL base oils, shown in Table 1, were used.

TABLE 1

| Description | XLBO | LBO | MLBO | MBO |
|---|---|---|---|---|
| Kinematic Viscosity @ 40° C. ($mm^2/s$) | 10.6 | 15.27 | 30.5 | 39.89 |
| Kinematic Viscosity @ 100° C. ($mm^2/s$) | 2.935 | 3.776 | 6.244 | 7.597 |
| Viscosity Index | 134 | 145 | 160 | 162 |
| Cloud Point (° C.) | −15 | −12 | −3 | 5 |
| Pour Point (° C.) | −26 | −21 | −20 | −13 |
| Density @ 20° C. (g/mL) | 0.8065 | 0.8152 | 0.8223 | 0.8252 |
| Cold Crank Viscosity @ −35° C. (mPa · s) | | 1830 | 5432 | 11634 |
| Cold Crank Viscosity @ −30° C. (mPa · s) | | 1053 | 2797 | 3831 |
| Oxidator BN (hours to 1 L $O_2$ uptake) | 36.89 | 37.83 | 43.03 | 45.42 |
| Noack Volatility (weight %) | 30.17 | 9.89 | 3.11 | 3.92 |
| Flash Point, ° C. | 214 | | | |
| n-d-M | | | | |
| Weight % Paraffinic Carbon | 95.22 | 93.78 | 93.58 | 92.46 |
| Weight % Naphthenic Carbon | 4.78 | 6.22 | 6.42 | 7.54 |
| Weight % Aromatic Carbon | 0.00 | 0.00 | 0.00 | 0.00 |
| Alkyl Branches/100 Carbons | 9.45 | 9.33 | 8.32 | 8.32 |
| Boiling Points by ASTM D6352-04, ° F. | | | | |
| $T_{10}$ | 698 | 729 | 846 | 862 |
| $T_{50}$ | 739 | 819 | 893 | 934 |
| $T_{90}$ | 772 | 875 | 930 | 1026 |
| $38 \times (KV100)^3$ | 961 | 2046 | 9251 | 16661 |

TABLE 1-continued

| Description | XLBO | LBO | MLBO | MBO |
|---|---|---|---|---|
| $38 \times (KV100)^{2.8}$ | 775 | 1568 | 6413 | 11107 |
| y in the equation: VI = 28 × Ln(KV100) + y | 104 | 108 | 109 | 105 |
| $900 \times (KV100)^{-2.8}$ | 44.15 | 21.80 | 5.33 | 3.08 |
| $1000 \times (KV100)^{-2.7}$ | 54.63 | 27.67 | 7.11 | 4.19 |

Density is determined by either ASTM D1480-02 or ASTM D1481-02. Pour Point is determined by ASTM D5950-02. Cloud Point is determined by ASTM D5771-05.

N-d-M is done according to ASTM D3238-95 (Re-approved 2005), with the results normalized if any of the carbon types were calculated to be negative. This method is for "olefin free" feedstocks which are assumed in this application to mean that that olefin content is 2 weight % or less. The normalization process consists of the following:

If the Ca value is less than zero, Ca is set to zero and Cn and Cp are increased proportionally so that the sum is 100%.

If the Cn value is less than zero, Cn is set to zero and Ca and Cp are increased proportionally so that the sum is 100%.

If both Cn and Ca are less than zero, Cp is set to 100%.

Branching properties were determined by analyzing a sample of oil using carbon-13 NMR according to the following seven-step process. References cited in the description of the process provide details of the process steps. Steps 1 and 2 are performed only on the initial materials from a new process.

1) Identify the CH branch centers and the $CH_3$ branch termination points using the DEPT Pulse sequence (Doddrell, D. T.; D. T. Pegg; M. R. Bendall, Journal of Magnetic Resonance 1982, 48, 323ff).
2) Verify the absence of carbons initiating multiple branches (quaternary carbons) using the APT pulse sequence (Patt, S. L.; J. N. Shoolery, Journal of Magnetic Resonance 1982, 46, 535ff).
3) Assign the various branch carbon resonances to specific branch positions and lengths using tabulated and calculated values (Lindeman, L. P., Journal of Qualitative Analytical Chemistry 43, 1971 1245ff; Netzel, D. A., et. al., Fuel, 60, 1981, 307ff).

Examples:

| Branch | NMR Chemical Shift (ppm) |
|---|---|
| 2-methyl | 22.5 |
| 3-methyl | 19.1 or 11.4 |
| 4-methyl | 14.0 |
| 4 + methyl | 19.6 |
| Internal ethyl | 10.8 |
| Propyl | 14.4 |
| Adjacent methyls | 16.7 |

4) Quantify the relative frequency of branch occurrence at different carbon positions by comparing the integrated intensity of its terminal methyl carbon to the intensity of a single carbon (=total integral/number of carbons per molecule in the mixture). For the unique case of the 2 methyl branch, where both the terminal and the branch methyl occur at the same resonance position, the intensity was divided by two before doing the frequency of branch occurrence calculation. If the 4-methyl branch fraction is calculated and tabulated, its contribution to the 4+ methyls must be subtracted to avoid double counting.
5) Calculate the average carbon number. The average carbon number may be determined with sufficient accuracy for lubricant materials by dividing the molecular weight (MW measured by ASTM D2503-92 [Re-approved 2002]) of the sample by 14 (the formula weight of $CH_2$).
6) The number of branches per molecule is the sum of the branches found in step 4.
7) The number of alkyl branches per 100 carbon atoms is calculated from the number of branches per molecule (step 6) times 100/average carbon number.

Measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15 to 25 percent by weight in chloroform-dl were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal of all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. Both are described in the references cited. The branching properties of each sample were determined by C-13 NMR using the assumption in the calculations that the entire sample was iso-paraffinic. Corrections were not made for n-paraffins or naphthenes, which may have been present in the oil samples in varying amounts.

The four different GTL base oils were mixed in the proportions shown in Table 2, to form an ATF base fluid with a viscosity of about 4.8 $mm^2/s$ at 100° C. Thus, the target high temperature (i.e., 100° C.) viscosity, 4.8 $mm^2/s$, was greater than the high temperature viscosity for the light base oil, 3.776 $mm^2/s$, but less than the high temperature viscosity for the medium-light base oil, 6.244 $mm^2/s$. The blended base oil viscosity target of 4.8 $mm^2/s$ at 100° C. was selected to provide acceptable low temperature properties (e.g., viscosity or pumpability). The medium base oil was not mixed with the medium-light base oil, as the combination would exceed the target base oil viscosity. The extra-light base oil was not mixed with the light base oil, as the combination would not provide acceptable high temperature properties (e.g., viscosity) and would require an unacceptably large amount of polymeric viscosity modifier to provide acceptable high temperature properties.

The primary target in mixing different GTL base oils to form an ATF base fluid is the high temperature viscosity of the ATF base fluid. Another key target in mixing different GTL base oils to form an ATF base fluid is the low temperature viscosity of the ATF base fluid. Secondary targets in mixing different GTL base oils to form an ATF base fluid are the flash point, Noack volatility, oxidation stability, and frictional characteristics of the ATF base fluid.

TABLE 2

| Description | XL + ML | XL + M | L + ML | L + M |
|---|---|---|---|---|
| Components (weight %) | | | | |
| XLBO | 37.23 | 50.42 | | |
| LBO | | | 64.36 | 75.42 |
| MLBO | 62.77 | | 35.64 | |
| MBO | | 49.58 | | 2458 |
| Kinematic Viscosity @ 40° C. ($mm^2/s$) | 20.43 | 21.02 | 21.12 | 21.59 |
| Kinematic Viscosity @ 100° C. ($mm^2/s$) | 4.696 | 4.834 | 4.791 | 4.886 |
| Viscosity Index | 156 | 161 | 155 | 158 |
| Estimated Density @ 15.6° C. (g/cc) | 0.8197 | 0.8187 | 0.8221 | 0.8220 |

From the point of view of an ATF formulator, the four ATF base fluids of Table 2 are essentially identical. The four ATF base fluids of Table 2 have the same approximate viscosity at 100° C., viscosity index, and density. In addition, the ATF base fluids are all nearly devoid of aromatics and should show similar solvent properties toward additive packages and polymeric viscosity index improvers.

The same ATF additive package (DI), Hitec 3491 was added to each of the four ATF base fluids of Table 2, and the resulting kinematic viscosities at 100° C. were measured. The additive package was used at a treat rate of 7.18 weight %, based on a completely formulated ATF. The additive package is currently the only officially approved package for blending DEXRON-VI ATF, which is the new generation ATF used by General Motors for factory and service fill. A fixed amount of polymethacrylate viscosity modifier, Hitec 5738, was added to each mixture of ATF base fluids and ATF additive package, to make a finished ATF. Three different treat rates of viscosity modifier (i.e., 0.5, 1.5, and 3.0 weight %) were used.

Table 3 shows the increase in viscosity after the addition of 7.18 weight % DI and then 0.5 weight % viscosity modifier (VM).

TABLE 3

| Base Fluid | Viscosity Increase After Adding 7.18 wt % DI ($mm^2/s$) | Viscosity Increase After Adding 0.5 wt % VM ($mm^2/s$) | Total Viscosity Increase Above Base Oil Level ($mm^2/s$) |
|---|---|---|---|
| XL + ML | 0.474 | 0.143 | 0.617 |
| XL + M | 0.476 | 0.143 | 0.619 |
| L + ML | 0.492 | 0.152 | 0.644 |
| L + M | 0.499 | 0.149 | 0.648 |

Thus, for the XL+ML ATF base fluid with a final concentration of 0.5 weight % VM in the blended ATF, the viscosity of the ATF base fluid was 4.696 $mm^2/s$ (see Table 2). After addition of the DI, the viscosity increased by 0.474 $mm^2/s$ to 5.170 $mm^2/s$. After addition of VM, to the ATF base fluid and DI, the viscosity further increased by 0.143 $mm^2/S$ to 5.313 $mm^2/s$.

Table 4 shows the increase in viscosity after the addition of 7.18 weight % DI and then 1.5 weight % VM.

TABLE 4

| Base Fluid | Viscosity Increase After Adding 7.18 wt % DI ($mm^2/s$) | Viscosity Increase After Adding 0.5 wt % VM ($mm^2/s$) | Total Viscosity Increase Above Base Oil Level ($mm^2/s$) |
|---|---|---|---|
| XL + ML | 0.482 | 0.423 | 0.905 |
| XL + M | 0.483 | 0.434 | 0.917 |
| L + ML | 0.500 | 0.452 | 0.952 |
| L + M | 0.507 | 0.454 | 0.961 |

Table 5 shows the increase in viscosity after the addition of 7.18 weight % DI and then 3.0 weight % VM.

TABLE 5

| Base Fluid | Viscosity Increase After Adding 7.18 wt % DI ($mm^2/s$) | Viscosity Increase After Adding 0.5 wt % VM ($mm^2/s$) | Total Viscosity Increase Above Base Oil Level ($mm^2/s$) | Delta Wt % Naphthenic Carbon | Delta Alkyl Br/100 Carbons |
|---|---|---|---|---|---|
| XL + ML | 0.492 | 0.888 | 1.380 | 1.64 | 1.13 |
| XL + M | 0.492 | 0.895 | 1.387 | 2.76 | 1.13 |
| L + ML | 0.509 | 0.92 | 1.429 | 0.20 | 1.01 |
| L + M | 0.511 | 0.932 | 1.443 | 1.32 | 1.01 |

Tables 3-5 show some surprising behavior. In general, it would be expected that the addition of a fixed amount of either DI or VM to any of the four ATF base fluids would result in the same increase in viscosity. However, the results clearly show that the viscosity increase differs, depending on the ATF base fluid, which indicates that there are different solvent-solute interactions occurring in the different ATF base fluids. Again, it would not be expected to see differences in solubility because the ATF base fluids are so similar with respect to viscosity, density, and chemical composition. In each of Tables 3-5, the highest increase in viscosity occurs with the L+M base fluid and the lowest increase in viscosity occurs with the XL+ML base fluid. Accordingly, the amount of expensive VM needed in formulating a finished ATF can be minimized by selecting the optimal blend of base oils, thus reducing total product cost.

TABLE 6

| Base Fluid | Delta Wt % Naphthenic Carbon | Delta Alkyl Br/100 Carbons | Delta $T_{50}$ Boiling Point, ° F. |
|---|---|---|---|
| XL + ML | 1.64 | 1.13 | 154 |
| XL + M | 2.76 | 1.13 | 195 |
| L + ML | 0.20 | 1.01 | 74 |
| L + M | 1.32 | 1.01 | 115 |

The example blends with the most effective polymer thickening (L+ML and L+M) were the two blends where the difference between the weight % naphthenic carbon of the higher viscosity oil and the weight % naphthenic carbon of the lower viscosity oil were between 0.10 and 1.5 weight %. These same example blends with the most effective polymer thickening were also the two blends where the difference between the alkyl branches per 100 carbons of the higher viscosity oil and the lower viscosity oil were less than 1.10. These same two example blends with the most effective polymer thickening had a smaller difference between the T50 boiling points by ASTM D6352-04. The two examples that had a difference, in degrees F., between the $T_{50}$ boiling points of the higher and lower viscosity base oils of less than 150 or 120 had improved polymer thickening.

In accordance with the example, in an embodiment, provided is a method for forming an automatic transmission fluid. The method comprises selecting a target high temperature viscosity for the automatic transmission fluid. A target high temperature viscosity for a base oil blend is selected. An extra-light base oil fraction, a light base oil fraction, a medium-light base oil fraction, and a medium base oil fraction are provided. A higher viscosity base oil fraction and a lower viscosity base oil fraction are mixed to form a base oil blend that meets the target high temperature viscosity of the base oil blend. The base oil blend is mixed with a performance additive package and a viscosity modifier to form an automatic transmission fluid that meets the target high temperature viscosity of the automatic transmission fluid. The higher viscosity base oil fraction and the lower viscosity base oil fraction for the base oil blend having the target high temperature viscosity are selected such that the amount of viscosity modifier needed to meet the target high temperature viscosity of the automatic transmission fluid is minimized. The higher viscosity base oil fraction has a kinematic viscosity at 100° C. greater than about 5 $mm^2/s$. The lower viscosity base oil fraction has a kinematic viscosity at 100° C. less than about 5 $mm^2/s$. The higher viscosity base oil fraction can be selected from the medium light base oil fraction, the medium base oil fraction, or mixtures thereof. The lower viscosity base oil fraction can be selected from the extra-light base oil fraction, the light base oil fraction, or mixtures thereof.

Many modifications of the exemplary embodiments disclosed herein will readily occur to those of skill in the art. Accordingly, the present disclosure is to be construed as including all structure and methods that fall within the scope of the appended claims.

What is claimed is:

1. A method of selecting two or more base oils to formulate a base oil blend with improved thickening efficiency, wherein the selecting is based on compositional properties of the two or more base oils, the method comprising:

measuring a weight percentage naphthenic carbon of a higher viscosity base oil, wherein the higher viscosity base oil comprises one or more from the group consisting of: a medium-light base oil and a medium base oil;

measuring a weight percentage naphthenic carbon of a lower viscosity base oil, wherein the lower viscosity oil comprises one or more from the group consisting of: an extra-light base oil and a light base oil;

determining a first difference between the weight percentage naphthenic carbon of the higher viscosity base oil and the weight percentage naphthenic carbon of the lower viscosity base oil;

determining the first difference is within a first numerical range, wherein the first numerical range is between 0.10 and 1.5 weight percentage;

after determining the first difference is within the first numerical range:

selecting the higher viscosity base oil;

selecting the lower viscosity base oil;

blending the higher viscosity base oil and the lower viscosity base oil to formulate a base oil blend;

blending the base oil blend with a performance additive package to form a base blend; and blending the base blend with an amount of a high molecular weight polymer viscosity modifier to form a finished lubricant.

2. The method of claim 1, wherein the base oils are Fischer-Tropsch derived.

3. The method of claim 1, wherein the base oil blend has a target flash point not lower than 170° C.

4. The method of claim 1, wherein the base oil blend has a target oxidation stability of an Oxidator BN value greater than about 25.

5. The method of claim 1, wherein the base oil blend has a Viscosity Index between about 130 and about 170.

6. The method of claim 1, wherein a difference between a $T_{50}$ boiling point of the higher viscosity base oil and a $T_{50}$ boiling point of the lower viscosity base oil is less than 150° F.

7. The method of claim 1, wherein the high molecular weight polymer is polymethacrylate.

8. The method of claim 1, wherein the finished lubricant has a target low temperature viscosity at −40° C. and a target high temperature viscosity at 100° C.

9. The method of claim 8, wherein the target low temperature viscosity of the finished lubricant is between about 2,000 and about 20,000 mPa·s.

10. The method of claim 8, wherein the target high temperature viscosity of the base oil blend is between about 3 and about 7.5 $mm^2/s$.

11. The method of claim 1, wherein the finished lubricant is an automatic transmission fluid.

12. The method of claim 8, wherein the finished lubricant has a target high temperature viscosity at 100° C. of between about 4 and about 10 $mm^2/s$.

13. The method of claim 1, wherein an interaction of the compositional properties of the formulated base oil blend maximizes an amount of viscosity increase while minimizing the amount of the viscosity modifier.

14. A method of selecting two or more base oils to formulate a base oil blend with improved thickening efficiency, wherein the selecting is based on compositional properties of the two or more base oils, the method comprising:

determining a number of alkyl branches per 100 carbons of a higher viscosity base oil, wherein the higher viscosity base oil comprises one or more from the group consisting of: a medium-light base oil and a medium base oil;

determining a number of alkyl branches per 100 carbons of a lower viscosity base oil, wherein the lower viscosity base oil comprises one or more from the group consisting of: an extra-light base oil and a light base oil;

determining a first difference between the number of alkyl branches per 100 carbons of the higher viscosity base oil and the number of alkyl branches per 100 carbons of the lower viscosity base oil;

determining the first difference is less than 1.10;

after determining the first difference is less than 1.10;

selecting the higher viscosity base oil;

selecting the lower viscosity base oil;

blending the higher viscosity base oil and the lower viscosity base oil to formulate a base oil blend;

blending the base oil blend with a performance additive package to form a base blend; and blending the base blend with an amount of a high molecular weight polymer viscosity modifier to form a finished lubricant.

15. The method of claim 14, wherein the high molecular weight polymer is polymethacrylate.

* * * * *